US011918862B1

(12) United States Patent
Fox

(10) Patent No.: US 11,918,862 B1
(45) Date of Patent: Mar. 5, 2024

(54) PICKLEBALL HOLDERS

(71) Applicant: Robert O. Fox, Knoxville, TN (US)

(72) Inventor: Robert O. Fox, Knoxville, TN (US)

( * ) Notice: Subject to any disclaimer, the term of this patent is extended or adjusted under 35 U.S.C. 154(b) by 186 days.

(21) Appl. No.: 17/698,281

(22) Filed: Mar. 18, 2022

(51) Int. Cl.
*A63B 47/00* (2006.01)
*A41D 13/00* (2006.01)
*A45F 5/02* (2006.01)

(52) U.S. Cl.
CPC ..... *A63B 47/001* (2013.01); *A41D 13/0015* (2013.01); *A45F 5/02* (2013.01); *A41D 2600/10* (2013.01)

(58) Field of Classification Search
CPC ..... A63B 47/00; A63B 47/001; A45F 5/02; A41D 13/0012; A41D 1/08; A41D 1/089; A41D 2600/10
USPC ..... 224/919, 255; 211/14; 206/493; 473/21; 2/249; 411/508–510; 248/309.2; 24/297; 242/597.3
See application file for complete search history.

(56) References Cited

U.S. PATENT DOCUMENTS 1,851,722 A * 3/1932 Moore ..... A47K 10/3836 242/422.4
2,171,648 A * 9/1939 Ennis ..... A47K 10/3836 411/347
3,136,419 A * 6/1964 Ruderian ..... A63B 47/00 206/315.9
3,143,265 A * 8/1964 Ruderian ..... A63B 57/20 294/142
3,907,287 A * 9/1975 Fox ..... A63B 69/0088 473/424
4,072,256 A * 2/1978 Young ..... A63B 47/001 294/166
4,286,496 A * 9/1981 Harris ..... B25C 1/188 411/908
4,664,255 A * 5/1987 Griffith ..... B65D 73/0007 206/427
4,767,074 A * 8/1988 Bower ..... A47K 10/3836 242/597.3
5,323,980 A * 6/1994 Neveu ..... A47K 10/3836 242/597.6
5,370,339 A * 12/1994 Moody ..... A47K 10/3836 242/599.4
5,813,550 A * 9/1998 Sheehan ..... A47F 5/0807 248/220.31
5,842,938 A * 12/1998 Garber ..... A63B 43/007 473/418
D423,339 S * 4/2000 Snell ..... D6/567
D426,084 S * 6/2000 Kim ..... D6/407
6,997,312 B1 * 2/2006 Reum-Schindler .... B65D 29/04 206/315.9
7,503,528 B2 * 3/2009 Adams ..... F16L 3/137 24/297
7,950,535 B1 * 5/2011 Schmid ..... A63C 17/0013 211/85.7

(Continued)

*Primary Examiner* — Justin M Larson
(74) *Attorney, Agent, or Firm* — Luedeka Neely, P.C.

(57) ABSTRACT

A ball holder for holding apertured plastic sporting balls having a plurality of apertures through the sporting balls, the ball holder including a frame and a plurality of projections extending outwardly from the frame. Each of the projections is configured to support one of the plastic sporting balls by being positioned to penetrate into one of the apertures of the plastic sporting ball for releasably supporting and retaining the apertured plastic sporting ball on the ball holder.

4 Claims, 6 Drawing Sheets

(56) References Cited

U.S. PATENT DOCUMENTS

| | | | | |
|---|---|---|---|---|
| 8,533,919 | B2 * | 9/2013 | Schliessner | F16B 5/0685 24/297 |
| 8,707,525 | B2 * | 4/2014 | Davies | F16B 5/0628 24/297 |
| 8,739,982 | B2 * | 6/2014 | Werner | F41A 23/18 211/119.003 |
| 9,033,197 | B2 * | 5/2015 | Bar | A45F 5/06 224/667 |
| D799,613 | S * | 10/2017 | Dillon | D21/713 |
| 10,197,081 | B2 * | 2/2019 | Koelling | F16B 12/22 |
| 10,226,680 | B2 * | 3/2019 | Simms | A63B 43/005 |
| D859,134 | S * | 9/2019 | Iacono | D23/262 |
| D883,779 | S * | 5/2020 | Koelling | F16B 12/22 D8/402 |
| 11,076,709 | B2 * | 8/2021 | Gillespie | F16B 5/0056 |
| 11,278,769 | B2 * | 3/2022 | Houghton | A63B 47/02 |
| 2011/0077109 | A1 * | 3/2011 | Crowley | A63B 69/0002 473/453 |
| 2013/0116068 | A1 * | 5/2013 | Traynor | A63B 69/0079 473/428 |
| 2015/0060623 | A1 * | 3/2015 | Nigro | G09F 3/12 248/309.2 |
| 2015/0139755 | A1 * | 5/2015 | Lu | H05K 7/142 411/510 |
| 2015/0209639 | A1 * | 7/2015 | Bishop | A63B 69/002 473/424 |
| 2020/0298081 | A1 * | 9/2020 | Scott | A63B 69/0091 |
| 2023/0293950 | A1 * | 9/2023 | Fox | A41D 13/0015 2/265 |

* cited by examiner

PICKLEBALL HOLDERS

FIELD

This disclosure relates to the field of holders for sporting balls. More particularly, this disclosure relates to holders and apparel configured for holding plastic sporting balls such as pickleballs and wiffle balls.

BACKGROUND

When playing the sport of pickleball, a user typically places one or more extra pickleballs in a pocket. This is inconvenient and often the pickleballs will fall out during play. What is needed is a way to more conveniently hold one or more extra pickleballs. Similar needs may be encountered in the sport of wiffle ball.

What is desired is a device specifically configured for holding apertured and slotted plastic sporting balls such as pickleballs and wiffle balls.

SUMMARY

The above and other needs are met by holders and apparel configured for holding apertured sports balls.

In one aspect, the disclosure provides a ball holder for holding apertured plastic sporting balls having a plurality of apertures through the sporting balls. The ball holder includes a frame and one or more projections extending outwardly from the frame. Each of the projections is configured to support one of the plastic sporting balls by being positioned to penetrate into one of the apertures of the plastic sporting ball for releasably supporting and snugly retaining the apertured plastic sporting ball on the ball holder.

In another aspect, the disclosure provides sports apparel configured for holding one or more apertured plastic sporting balls having a plurality of apertures through the sporting balls. The sports apparel includes an article of sports apparel and one or more flexible projections integrated with the article of sports apparel and extending outwardly from the article of sports apparel. Each of the flexible projections is configured to support one of the plastic sporting balls by penetrating into one of the apertures of the plastic sporting ball for releasably supporting and snugly retaining the apertured plastic sporting ball on the article of sports apparel.

In a further aspect, the disclosure provides a ball holder system, including a plurality of apertured plastic sporting balls having a plurality of apertures through the sporting balls; and a ball holder for holding the plastic sporting balls. The ball holder has a frame and one or more flexible projections extending outwardly from the frame. Each of the flexible projections is configured to support one of the plastic sporting balls by penetrating into one of the apertures of the plastic sporting ball for releasably supporting and snugly retaining the apertured plastic sporting ball on the ball holder.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 5:
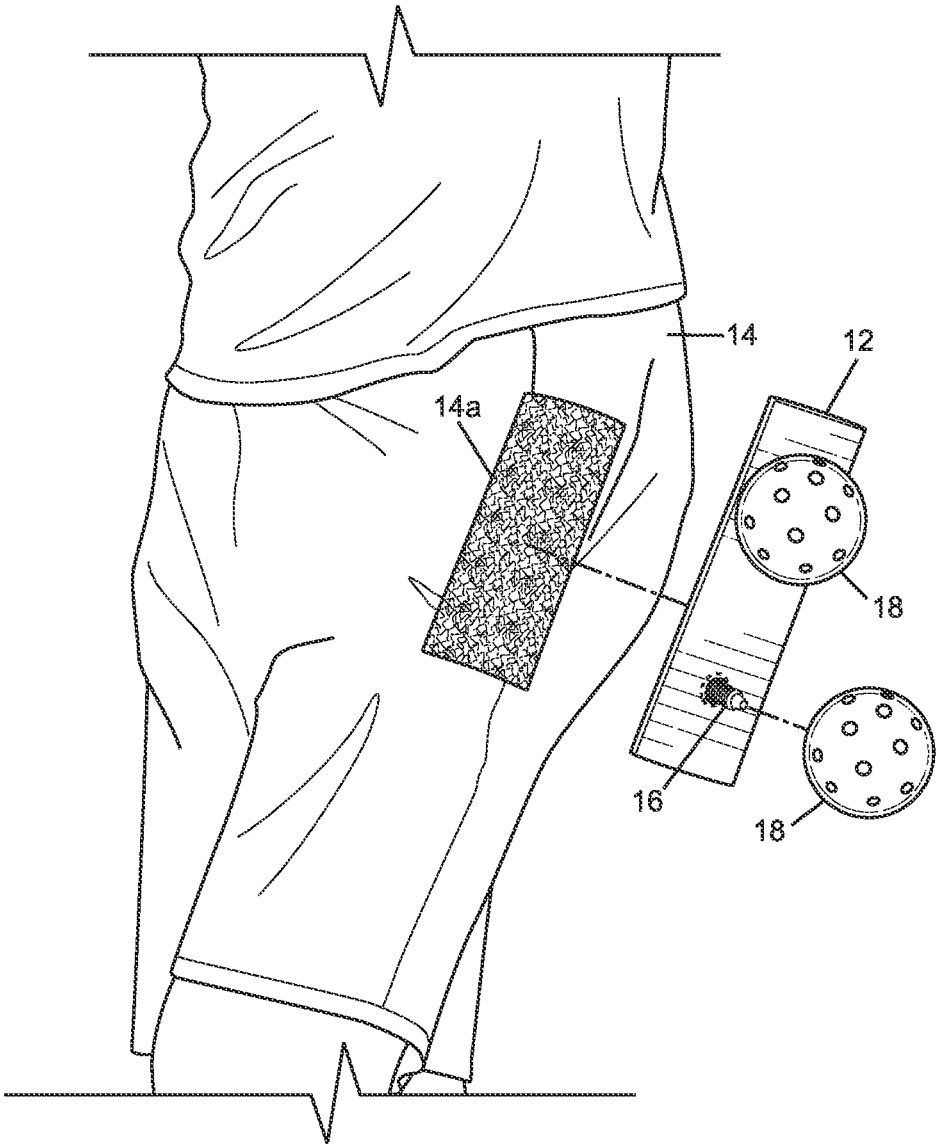
FIG. 5 shows an alternate embodiment of a holder according to the disclosure.
Figure 6:
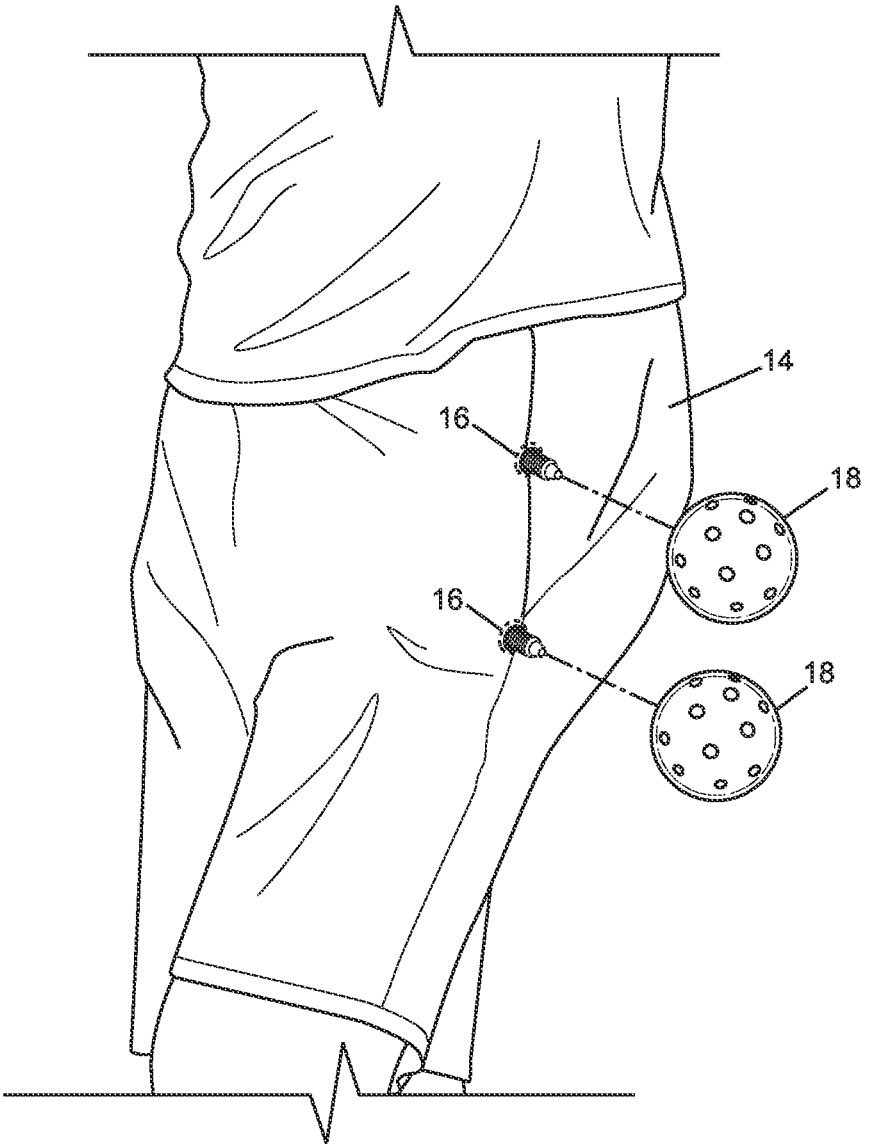
FIG. 6 shows a further embodiment of a holder according to the disclosure.

With initial reference to FIGS. 1-4, there is shown a sports ball holder 10 according to the disclosure. The holder 10 includes a frame 12 configured to slip over and be frictionally retained on an article of apparel, such as over the waist band of a pair of athletic shorts 14 or the like apparel of a pickleball or wiffle ball player. A pair of spaced apart flexible and compressible projections 16 are located on an outward facing surface of the frame 12. The projections 16 are configured to releasably but snugly engage and retain a hard and hollow plastic ball 18, such as a hard plastic pickleball or a hard plastic wiffle ball, having apertures 18*a*. FIGS. 5 and 6 show alternate embodiments of ball holders. The holders described herein are also aesthetically pleasing.

The frame 12 is desirably of thin and lightweight molded plastic, rubber, or the like. The frame 12 is J-shaped and secures onto the waist band of apparel as by a catch 12*a*. The frame 12 may be fairly rigid or may be flexible. The frame 12 may also be of a fabric or other sheet material suitable for supporting the projections 16 for use in holding the balls 18.

The apparel represented by the shorts 14 may alternately be a shirt or other clothing item, or a sports bag or the like substrate or surface, to which the holder 12 is applied.

The projections 16 are configured to releasably but snugly engage one of the apertures 18*a* of the pickleball 18 or other sports ball. The projections 16 are configured to retain the pickleballs 18 thereon until deliberately removed by the player. Two of the projections 16 are shown. The number of projections 16 may be one, two or more as needed to hold a desired number of the balls 18.

The projections 16 are preferably formed of a soft and flexible/compressible polymer such as rubber, silicone, or plastic that is compressible so as to compress/flex for insertion through the apertures 18*a* to frictionally hold the ball 18 on the projection 16. As used herein, the terms flexible and compressible are used interchangeably in connection with the characteristics of the projections 16 to reduce to the size of the aperture 18*a* so as penetrate into and snugly grip the apertures 18*a* to frictionally and snugly retain the ball 18 on the projection 16. A more rigid projection 16 may be used. For example, a plastic more rigid than the plastic of the ball 18. In such case, the plastic of the ball 18 at the aperture 18*a* may slightly flex or compress so as to deform as the projection 16 is inserted to snugly receive the projection 16. However, this is less preferred for use on holders worn on the body of a player, but may be better utilized for holders not worn on the body of the player.

The projections 16 may also have ribs or other rugous surface structures that compress to fit into the apertures 18*a* of the ball 18. The projections 16 are sufficiently rigid along their length axis to penetrate into one of the apertures 18*a* of the ball 18 for installation and maintenance of the ball 18 onto the projection 16, but preferred projections 16 to be worn by the player are desirably configured to flex relatively easily under any appreciable force to bend and flex in the event the player falls or the like. Thus, if the projections 16 come into contact with the ground they bend and flex.

FIGS. 2 and 3A-3C depict examples of preferred shapes for the projections 16. It is desirable that the projections 16 are fairly short, with the length of the projections 16 being sufficient so that the free-end extends just interior the thickness of the sidewall of the ball 18 but sufficiently deep so that the ball 18 is frictionally and snugly retained on the projection 16 during player movement. Thus, while the user is running, hitting the ball, and the like during play, the ball 18 does not appreciably wobble or move relative to the projection 16 while it is retained thereon.

Figure 1:
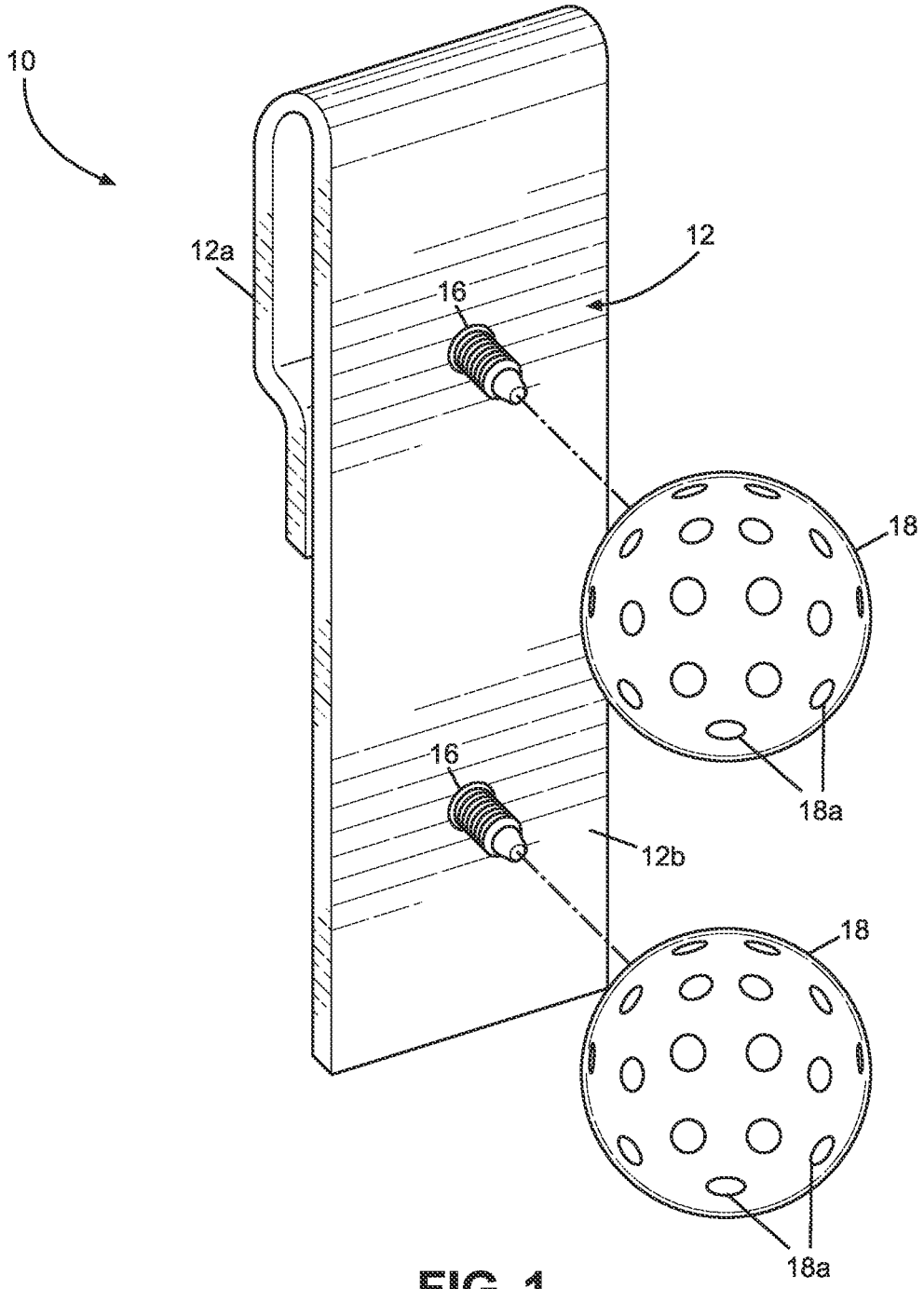
FIG. 1 is a perspective view of a pickleball holder according to one embodiment of the disclosure.
Figure 2:
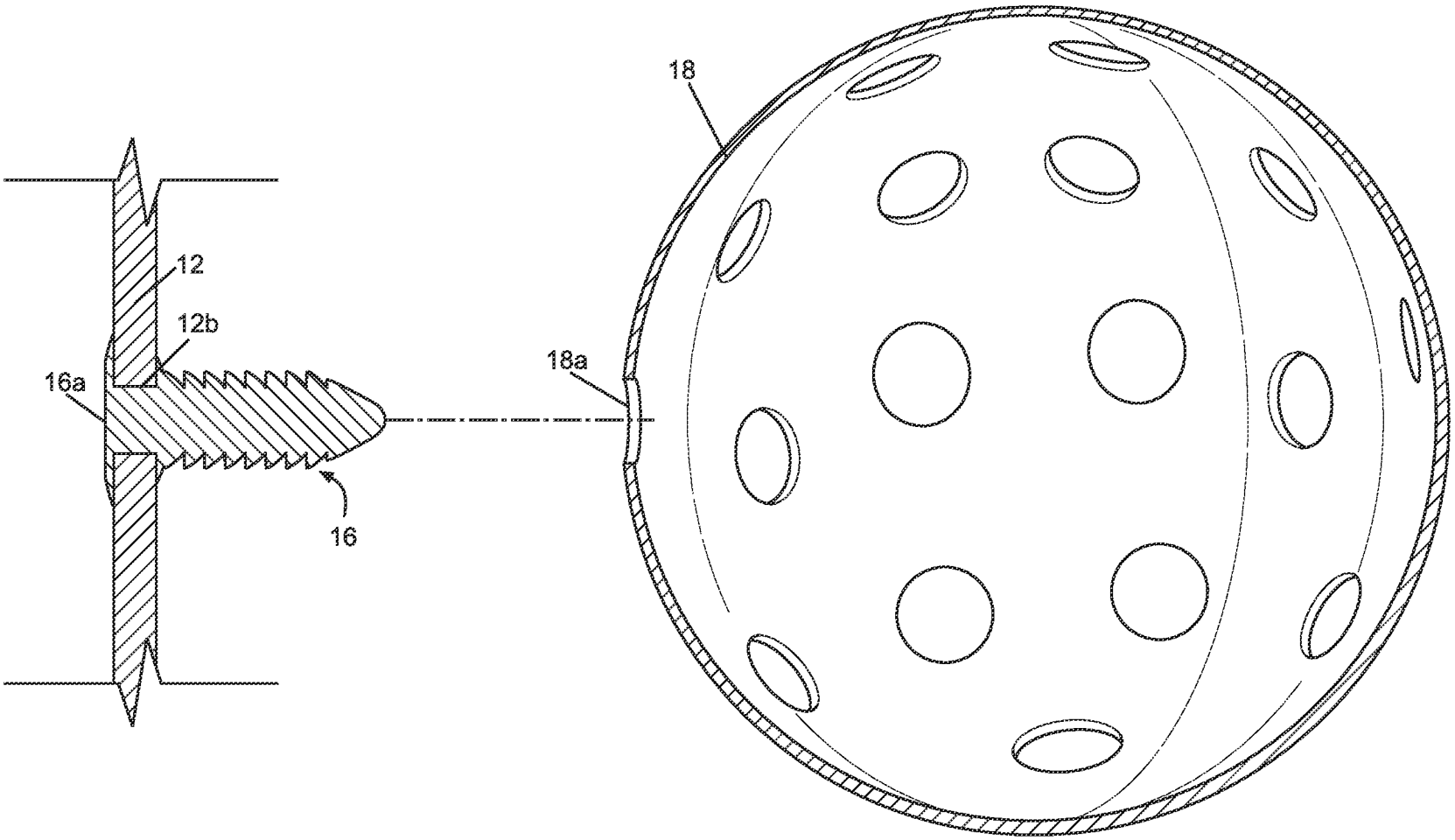
FIG. 2 is a cross-sectional view of a portion of the holder showing installation of a projection thereon.
Figure 3A:
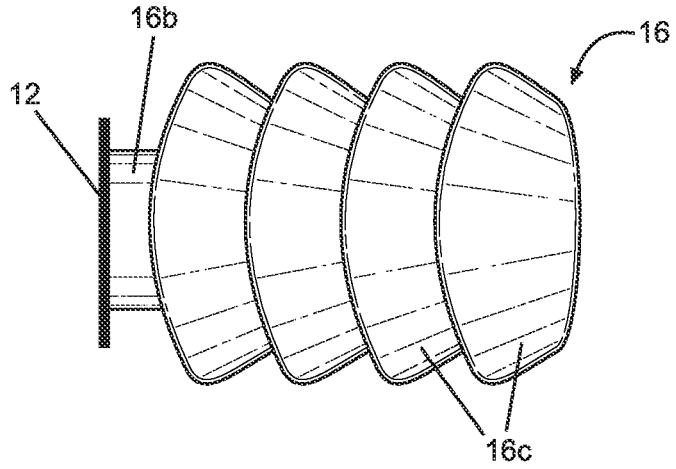
FIGS. 3A-3C show alternate projection structures.
Figure 3B:
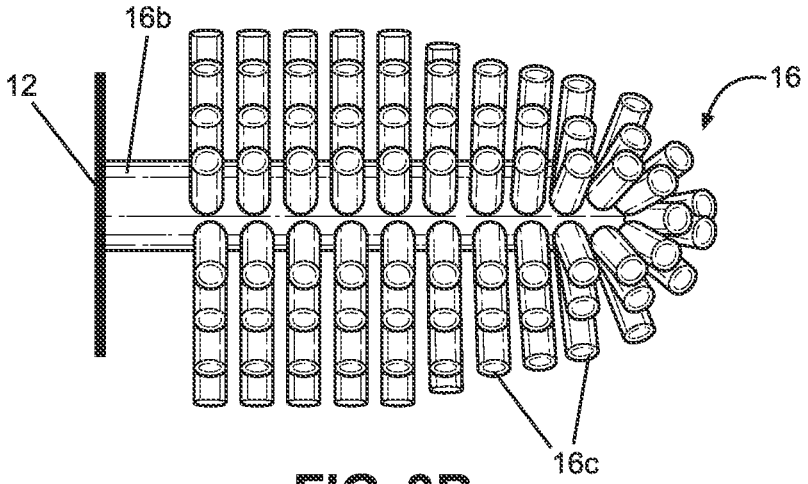
Figure 3C:
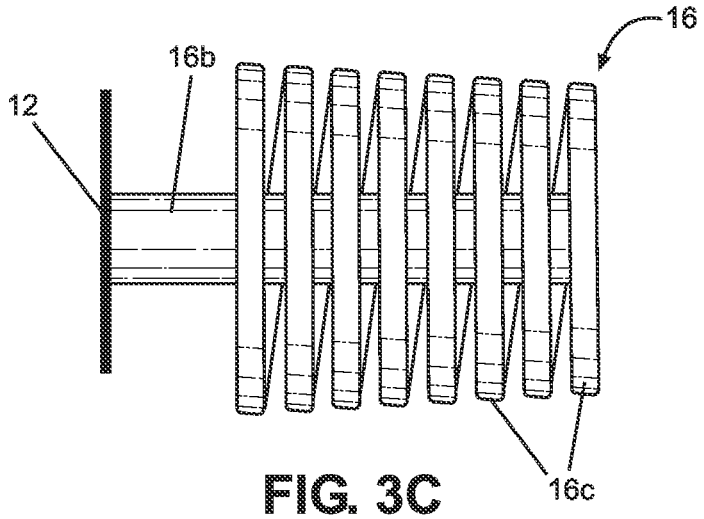

The projections 16 may have a head 16*a* and extend through apertures 12*b* of the frame 12, as shown in FIG. 2. The head 16*a* may be secured to the frame 12 as by friction, adhesive or sonic welding or the like. Alternatively, as shown in FIGS. 3A-3B, the projections 16 may be formed on or with the surface of the frame 12. In either case, the projections 16 are fixed to and extend away from the surface of the frame 12 so as to be positioned to penetrate one of the apertures 18*a*. The projections 16 are shown extending generally perpendicularly away from the exterior surface of the frame 12, but could be oriented at an upward or downward angle. The projections 16 may be co-formed with the frame 12 or added thereto.

The projections 16 are generally configured to have an elongate shank 16*b*. The projections 16 are compressible so as to compress/flex for insertion through the apertures 18*a* to frictionally retain the ball 18 on the projection 16. The projections 16 may be smooth and preferably tapered, but desirably may further include a plurality of relatively uniformly spaced apart radial raised flexible surfaces 16*c* formed along the length of the shank 16*b* to further aid in frictional retention of the ball 18 on the projection 16. The flexible surfaces 16*c* may be provided in the nature of fins, bulbs, nibs, ribs and the like as shown. The flexible surfaces 16*c* flex or compress as the projection 16 penetrates through the aperture 18*a*, and then relax and substantially return to their original shape. This occurs during installation of the ball 18 onto the projection 16 and during removal of the ball 18 from the projection 16. The flexible surfaces 16*c* may be all the same size or of differing size, such as providing the surfaces in a tapered or cone shape as shown on some of the embodiments.

The ball 18 depicted is a pickleball and will be referenced herein as a pickleball in the examples, with it being understood that that the structures described herein are A compatible with balls of similar structure, such as wiffle balls. The pickleball 18 is a hollow ball made of plastic having the apertures 18*a*, which are generally circular in configuration for a pickleball. Pickleballs generally have a diameter of between about 2.8 and 2.9 inches with a circumference of between about 9.0 and 9.4 inches and a weight of between about 0.7 and 1.0 ounces. The pickleball 18 typically has 26-40 of the circular apertures 18*a*, with the apertures 18*a* being evenly spaced. Indoor use pickleballs have 26 holes each 8 mm in diameter. Outdoor use pickleballs typically have 40 of the circular apertures 18*a* each slightly larger in diameter.

A wiffle ball is similarly constructed, but slightly smaller with apertures in the nature of oblong holes or slots on one side of the ball, and no holes or slots on the other side of the ball. The projections 16 are preferably configured to work with both indoor and outdoor pickleballs, or they may be specific to each type of pickleball. Similarly, a wiffle ball has slots and the projections 16 engage one of the slots.

Figure 4:
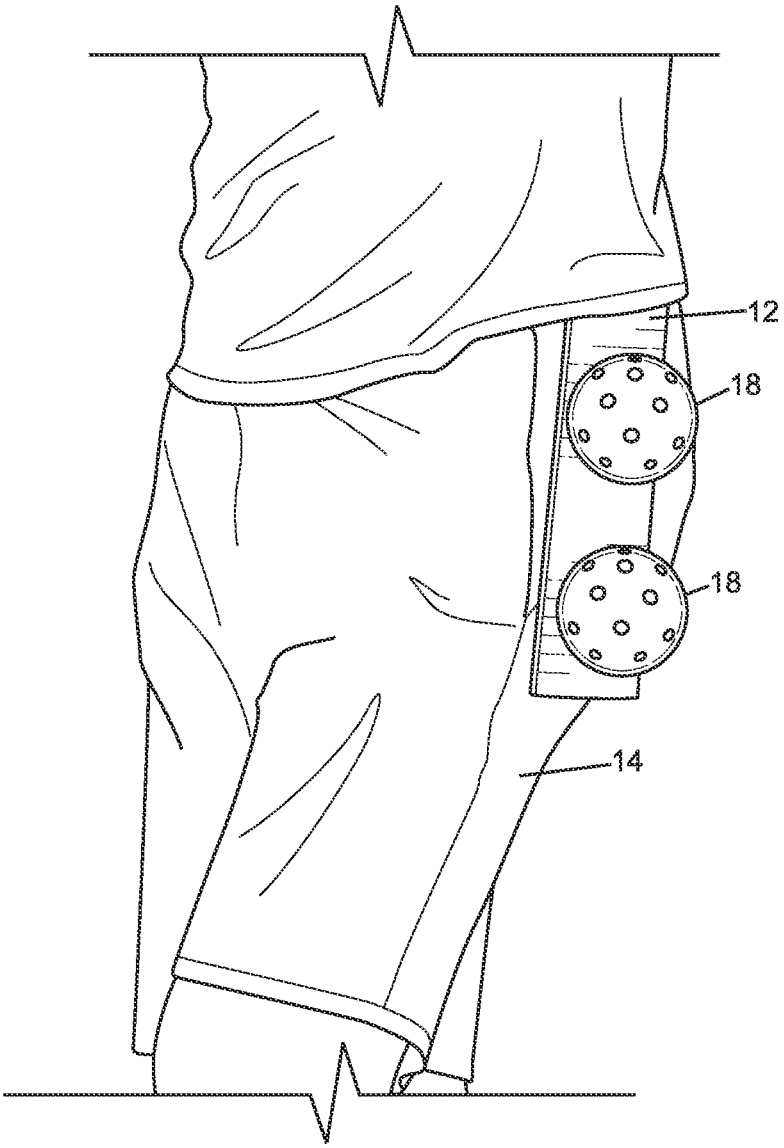
FIG. 4 shows the holder in use.

As shown in FIG. 4, the holder 12 is installed onto the shorts 14 as by clipping the catch 12*a* over the waistband of the shorts 14, preferably alongside of the side of the leg of the shorts where it will be convenient for the player to easily reach and install or remove the balls 18. The holder 12 may be installed on other apparel by use of the catch 12*a*, including apparel in the nature of a shirt or other clothing item, or a sports bag or the like. Likewise, the holder 12 may be secured to a courtside support for holding the balls 18.

With reference to FIG. 5, there is shown an alternate embodiment of the holder 12 configured with the frame 12 not being J-shaped and not including the catch 12*a*. Instead, the shorts 14 include a loop/hook material 14*a* and the holder 12 includes a mating hook/loop material on the backside thereof to releasably mate with the loop/hook material 14*a*. Alternatively, fastening structures other than hook/loop, such as snaps and the like, may be used to releasably or permanently mate the holder 12 to the shorts 14. The holder 12 of this embodiment may also be applied to other support surfaces.

With reference to FIG. 6, there is shown a further embodiment in which the apparel, shown as the shorts 14, include the projections 16 built therein so as to be integrated into the shorts 14. If desired for additional strength, a very thin flexible frame 12 without the catch 12*a* could be utilized and integrated into the shorts 14 to provide support for the projections. As noted above, the apparel could alternately be a shirt or other clothing item, or a sports bag or the like or other support surface, having the projections built therein in the manner shown on the shorts 14.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. Sports apparel configured for holding one or more apertured plastic sporting balls having a plurality of apertures through the sporting balls, the sports apparel comprising:

an article of sports apparel and one or more flexible projections integrated with the article of sports apparel and extending outwardly from the article of sports apparel, each of the flexible projections configured to support one of the plastic sporting balls by penetrating into one of the apertures of the plastic sporting ball for releasably and snugly supporting and retaining the apertured plastic sporting ball on the article of sports apparel; wherein each of the one or more of flexible projections comprises an elongate shank having a plurality of raised flexible surfaces formed along the shank, wherein the flexible surfaces flex as the projection penetrates through the aperture of the apertured plastic sporting ball during installation of the ball onto the projection and during removal of the ball from the projection.

2. The sports apparel of claim 1, wherein the sports apparel comprises a pair of shorts.

3. A ball holder system, comprising:

a plurality of apertured plastic sporting balls having a plurality of apertures through the sporting balls; and a ball holder for holding one or more of the plastic sporting balls, the ball holder having frame and one or more flexible projections extending outwardly from the frame, each of the flexible projections configured to support one of the plastic sporting balls by penetrating into one of the apertures of the plastic sporting ball for releasably supporting and snugly retaining the apertured plastic sporting ball on the ball holder; wherein each of the one or more of flexible projections comprises an elongate shank having a plurality of raised flexible surfaces formed along the shank, wherein the flexible surfaces flex as the projection penetrates through the aperture of the apertured plastic sporting ball during installation of the ball onto the projection and during removal of the ball from the projection.

4. The system of claim 3, wherein the ball holder is installable onto an article of apparel.

* * * * *